United States Patent [19]

Kowtko et al.

[11] Patent Number: 5,066,216

[45] Date of Patent: Nov. 19, 1991

[54] APPARATUS FOR INJECTION OF VISCOUS MATERIAL

[75] Inventors: Robert M. Kowtko, Long Valley, N.J.; Richard A. Mellwig, Tatamy, Pa.

[73] Assignee: Binney & Smith Inc., Easton, Pa.

[21] Appl. No.: 410,937

[22] Filed: Sep. 22, 1989

[51] Int. Cl.[5] ..... B29C 45/23

[52] U.S. Cl. ..... 425/562; 137/862; 425/566; 425/803

[58] Field of Search ..... 425/562, 566, 803; 137/862, 869, 625.48; 264/328.8

[56] References Cited

U.S. PATENT DOCUMENTS

| | | | |
|---|---|---|---|
| 735,304 | 8/1903 | Schnetzer | 425/577 X |
| 1,786,634 | 12/1930 | Sgritta | 425/803 X |
| 2,330,369 | 9/1943 | Marsh | 425/572 X |
| 2,380,042 | 7/1945 | Hauton | 425/568 X |
| 2,777,466 | 1/1957 | Ericson | 137/862 X |
| 3,577,597 | 5/1971 | Draudt et al. | 425/562 X |
| 3,740,810 | 6/1973 | Austin | 29/281.5 X |
| 3,957,408 | 5/1976 | Clymer et al. | 425/803 X |
| 4,043,740 | 8/1977 | Gellert | 425/567 |
| 4,080,147 | 3/1978 | Dumortier | 425/557 X |
| 4,082,491 | 4/1978 | Clymer et al. | 425/803 X |
| 4,172,113 | 10/1979 | Featherstone et al. | 264/319 |
| 4,212,627 | 7/1980 | Gellert | 425/566 X |
| 4,669,971 | 6/1987 | Gellert | 264/328.8 X |
| 4,761,343 | 8/1988 | Gellert | 425/571 X |
| 4,850,793 | 7/1989 | Silvestri, Jr. et al. | 137/862 X |

FOREIGN PATENT DOCUMENTS 1586111 5/1970 Fed. Rep. of Germany .

*Primary Examiner*—Richard L. Chiesa

*Attorney, Agent, or Firm*—Neuman, Williams, Anderson & Olson

[57] ABSTRACT

The present invention relates to an apparatus for injecting viscous materials. The apparatus includes a vertically adjustable manifold valve which receives a continuously circulating supply of pressurized viscous material. The manifold valve is positioned above a container or mold cavity to be filled with the viscous material. When the manifold valve is opened, the viscous material is injected into the containers or molds.

7 Claims, 6 Drawing Sheets

Fig. 4
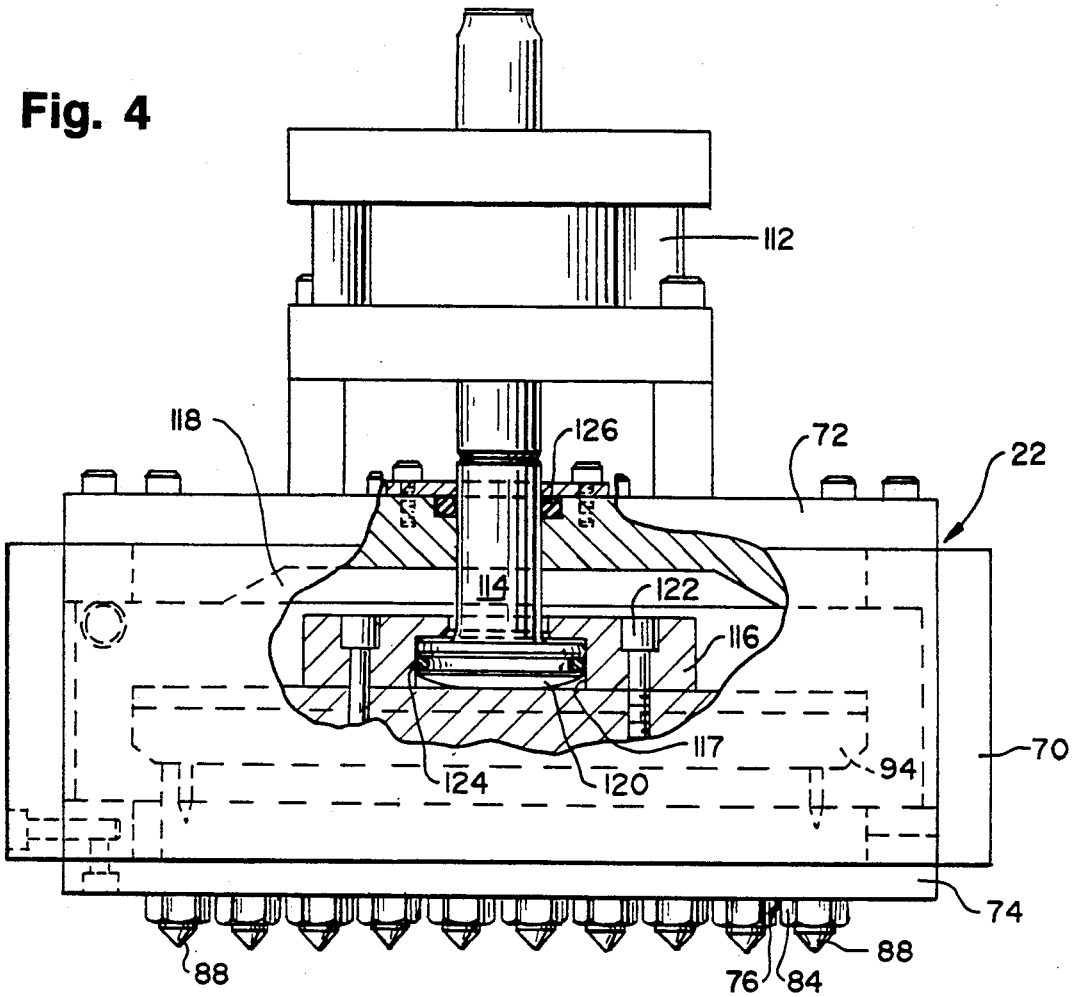
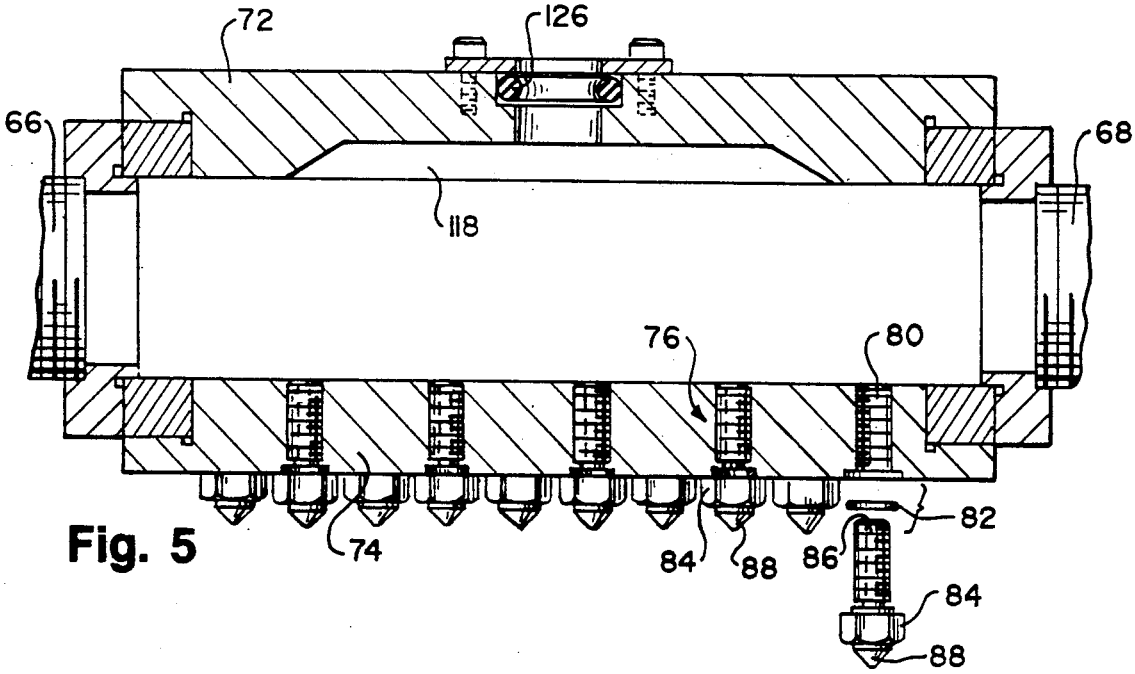
Fig. 5

Fig. 9
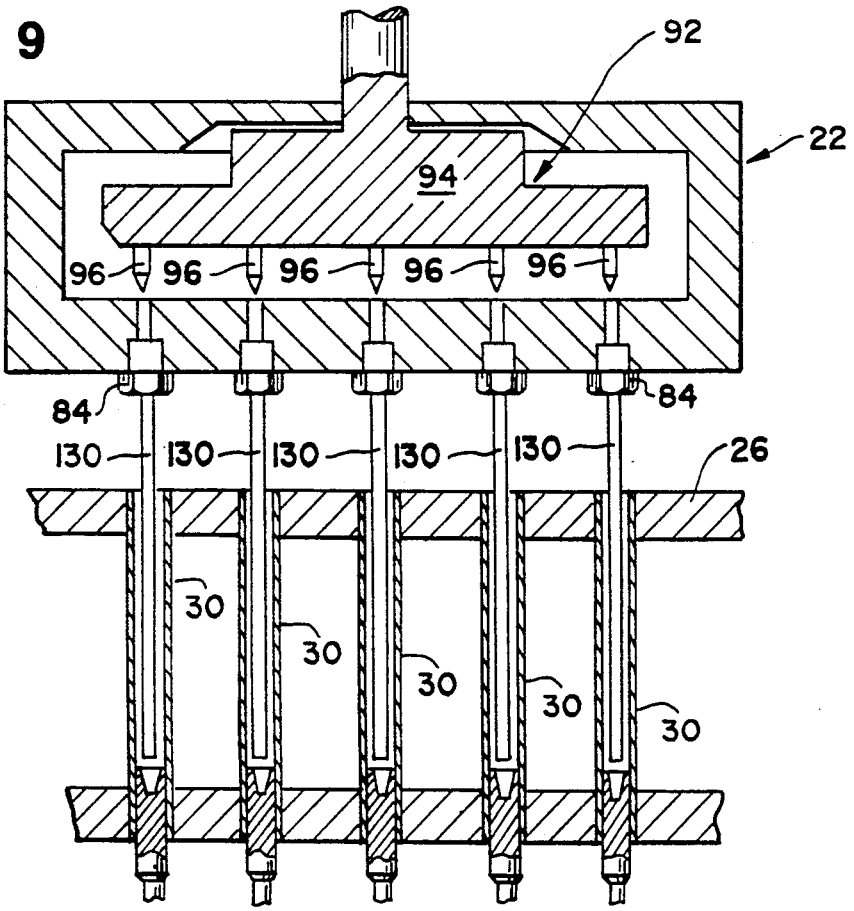
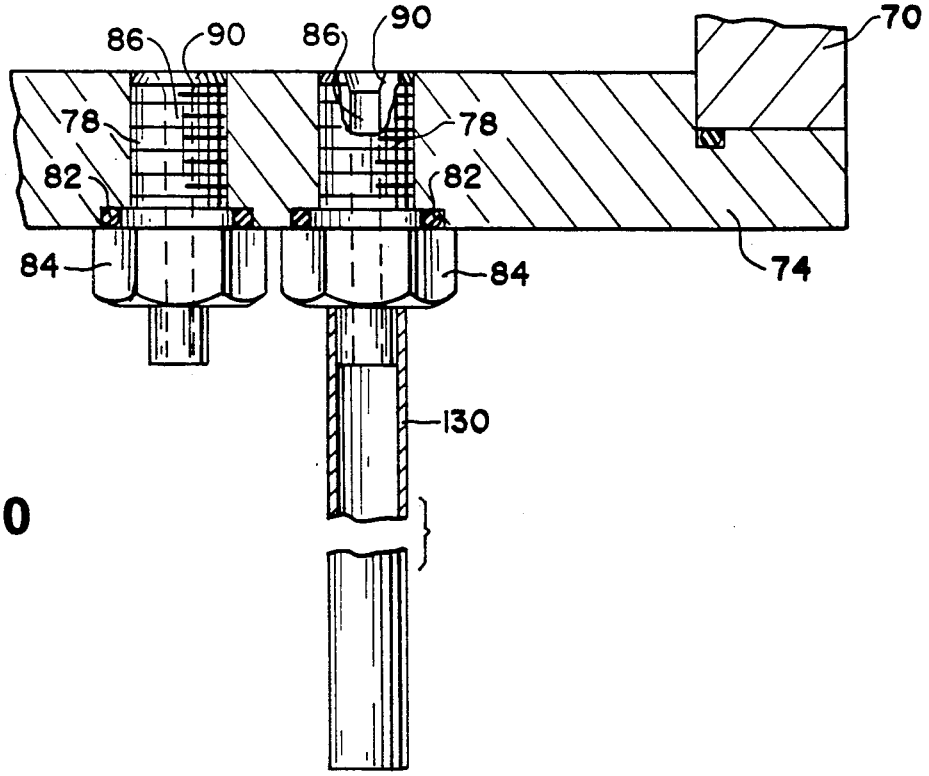
Fig. 10

APPARATUS FOR INJECTION OF VISCOUS MATERIAL

FIELD OF THE INVENTION

The present application relates to an apparatus for injecting viscous material into packaging containers for producing products such as tooth pastes, lip sticks and lip balms, and paints, or into mold cavities for forming a final molded product. The preferred embodiment of the present invention relates to an apparatus for injecting a molten wax blend to form and manufacture crayons.

BACKGROUND OF THE INVENTION

In conventional crayon manufacturing apparatuses, gravity is utilized for filling the mold cavities with molten wax. Typically, a heated mold table, containing several mold compartments of multiple crayon mold cavities is flooded with a layer of a molten wax blend which flows into the crayon mold cavities to fill the molds. The table is then cooled and the wax sets to form the crayons. When the process is complete, the excess wax is scraped off the table top and recycled. However, this type of gravity process can cause air pockets to form in the individual mold cavities if the wax is too viscous or if the mold is too cold and allows the wax to solidify on the sidewalls of the cavities before the entire mold cavity can fill. Consequently, to avoid these problems, the crayon wax must be maintained at a sufficiently high temperature to maintain an appropriate viscosity, usually 245° F. or higher, and the mold itself must not only be maintained at an appropriately high temperature to avoid premature cooling of the wax but must also be capable of rapid cooling to solidify the wax at the appropriate time.

As is readily apparent, the temperature of the wax is directly proportional to the time required to manufacture a finished crayon. Specifically, the higher the wax temperature, the longer time that is required for the wax to cool and the finished crayon to be completed. However, the higher the wax temperature, the less viscous the wax is and, as a result, the more quickly and completely it fills the mold cavities. Thus, a manufacturer must decide what temperature of wax is high enough to succeed in a gravity fill process but not too high to complicate cooling and lengthen the molding process.

Accordingly, it is the primary object of the present invention to provide a crayon manufacturing apparatus which can use wax at a reduced temperature, thereby reducing the time to mold crayons, and which can also eliminate the formation of air pockets within the crayon body. It is another object of the present invention to provide an injection apparatus capable of injecting a variety of highly viscous materials into final packaging containers or into molds for the creation of a variety of finished products.

SUMMARY OF THE INVENTION

To overcome the foregoing problems, the present invention employs an injection system which maintains the wax under pressure and injects the molten wax blend into the mold cavities. In this manner, the individual mold cavities will be completely filled without air pockets, the wax can be maintained at a lower temperature and at a higher state of viscosity than in conventional devices, and the excess pool of wax necessary to fill the mold cavities by gravity methods can be eliminated. As a result, less cooling time is required to form the finished product thereby decreasing the overall time for manufacturing a finished crayon. Thus, more crayons can be manufactured in the same time period as are previously manufactured using conventional devices.

The present invention further eliminates the need to preheat and maintain the high temperature of the mold cavities during the wax fill period as is required with gravity fill devices. Thus, the equipment necessary to perform that function can be eliminated, saving still further time and related costs.

More specifically, the preferred embodiment of the present invention provides a vertically adjustable injector for injecting viscous material, such as molten wax, into a plurality of mold cavities arranged on an indexed mold table. The injector comprises a manifold valve having an internal vertically adjustable platen which acts to seal and unseal a plurality of injection orifices disposed in overlying relation to the mold cavities. Pressurized molten wax is continuously circulated between the manifold valve and a reservoir by a pump. When the mold table has positioned an empty set of mold cavities below the manifold valve, a process control valve, positioned downstream from the manifold valve, closes the wax flow line and, simultaneously, the manifold valve platen raises to allow the wax to be injected into the mold cavities. When the cavities are filled, the process control valve opens, the manifold valve closes and the wax resumes circulation.

Both the manifold valve and process control valve, as well as other system components are operated and controlled by a programmable controller. The programmable controller is a microprocessor which monitors select system parameters and controls the operation of the overall system in response to the conditions identified by the system sensors.

The vertical adjustability of the manifold valve allows the present invention to be used with a variety of mold shapes. For example, extensions can be added to the respective injection orifices so that the viscous material can be introduced directly into the bottom of the mold rather than injected in from the top. As the mold fills with viscous material, the manifold valve is simultaneously raised until the molds are filled.

It also will be readily apparent upon review of the following specification that the injection system of the present invention is equally applicable for use with a wide variety of viscous materials. Specifically, besides being used in a molding process, the present invention could be applied in filling lipstick or lip balm containers, toothpaste containers, paint containers, or with other highly viscous products in other molding capacities such as in the manufacture of candles.

BRIEF DESCRIPTION OF THE DRAWINGS

For a more complete understanding of this invention, reference should now be made to the embodiment illustrated in greater detail in the accompanying drawings and described below by way of examples of the invention.

FIG. 4 is a front elevational view of the manifold of the present invention partially broken away to show the platen coupling.

FIG. 5 is a cross-sectional side view of the manifold of the present invention with the platen and coupling removed.

FIG. 9 is a cross-sectional schematic view of the manifold and mold compartment further showing orifice extensions attached to the orifices.

FIG. 10 is an enlarged cross-sectional view of an orifice with and without an orifice extension.

It should be noted that the invention is not necessarily limited to the particular embodiments illustrated herein. Moreover, for clarity, FIGS. 2 and 4–10 do not show each orifice and orifice pin, but only a representative sample for understanding.

DETAILED DESCRIPTION OF THE PREFERRED EMBODIMENT

Figure 11:
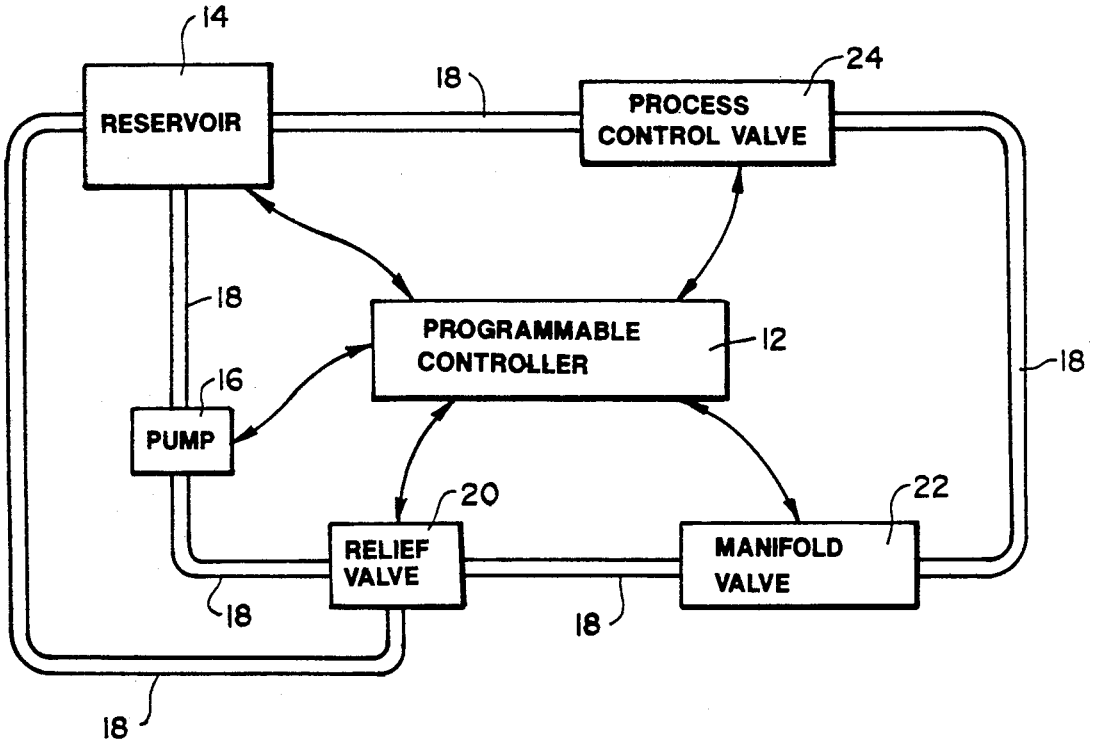
FIG. 11 is a schematic diagram of the components involved in the control of the flow of the viscous material.

Operation of the injection molding apparatus 10 can best be understood with first reference to FIG. 11. At the heart of the system is a programmable controller 12 or microprocessor which monitors certain specific system parameters and also controls, operates and synchronizes the various components of the overall system. As can be seen, the viscous material circulates through a flow path which includes a heated reservoir 14 for maintaining the viscous material in a molten state, a pump 16 for circulating the viscous material through the conduit or piping 18 which defines the flow path, a safety relief valve 20, in communication with the reservoir 14, for venting the system if the internal pressure exceeds predetermined levels, a manifold valve 22 for injecting the viscous material into mold cavities or other containers and a process control valve 24 for closing or blocking the flow path of the viscous material during injection.

Figure 1:
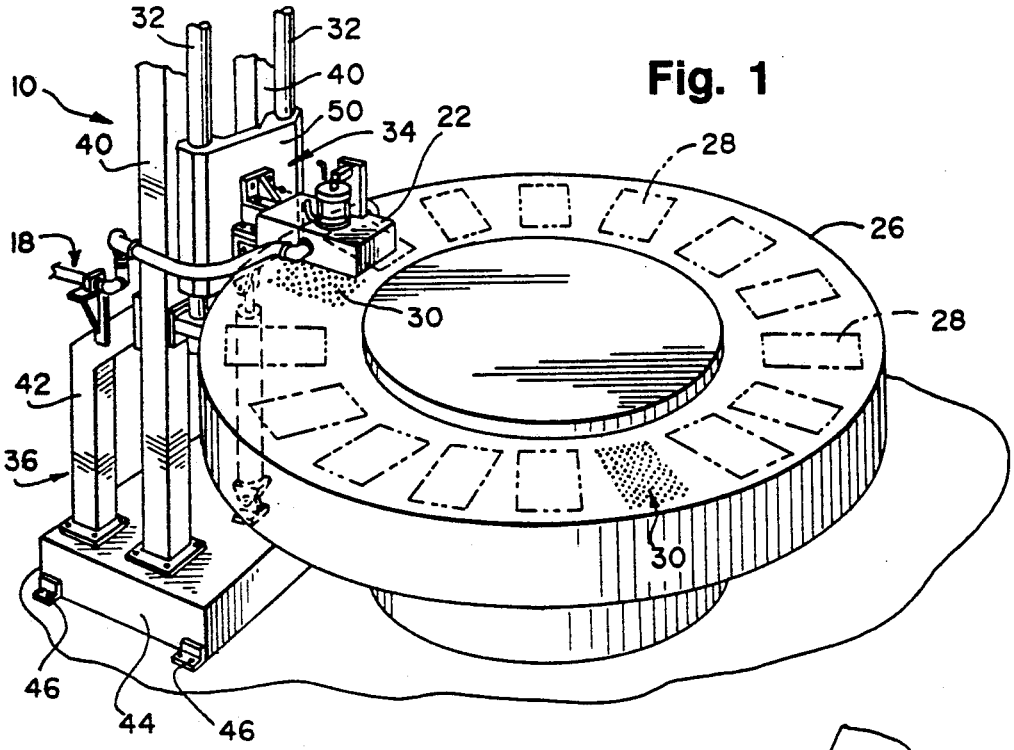
FIG. 1 is a perspective view of the injection molding apparatus of the present invention.

Turning now to FIG. 1, the preferred embodiment of the injection molding apparatus 10 of the present invention is shown together with a rotary mold table 26. The injection molding apparatus 10 includes a vertically adjustable manifold valve 22 which is positioned above the mold table 26 and continuously receives a recirculating supply of molten wax for injection into the appropriate mold cavities. The mold table can be provided with a number of mold compartments 28 containing numerous mold cavities 30 of varying patterns. The mold cavities 30 shown in FIG. 1 are for the manufacture of crayons.

The mold table has an internal cooling system (not shown) which circulates fluids or refrigerants to cool the molten wax after it has been received into the mold cavities 30. In addition, the table is connected to a motor (not shown) which is timed with the injection process to rotate or index the table after injection has been completed and advance subsequent mold cavities 30 to a position aligned with the injection manifold valve 22. The position of the mold table is monitored by the programmable controller 12 in order to advance the mold table at the correct time. More specifically, the mold table 26 will not advance unless the manifold valve 22 has finished injection and is in a specific position, and the manifold valve will not initiate injection unless the mold table is in the correct position.

Figure 2:
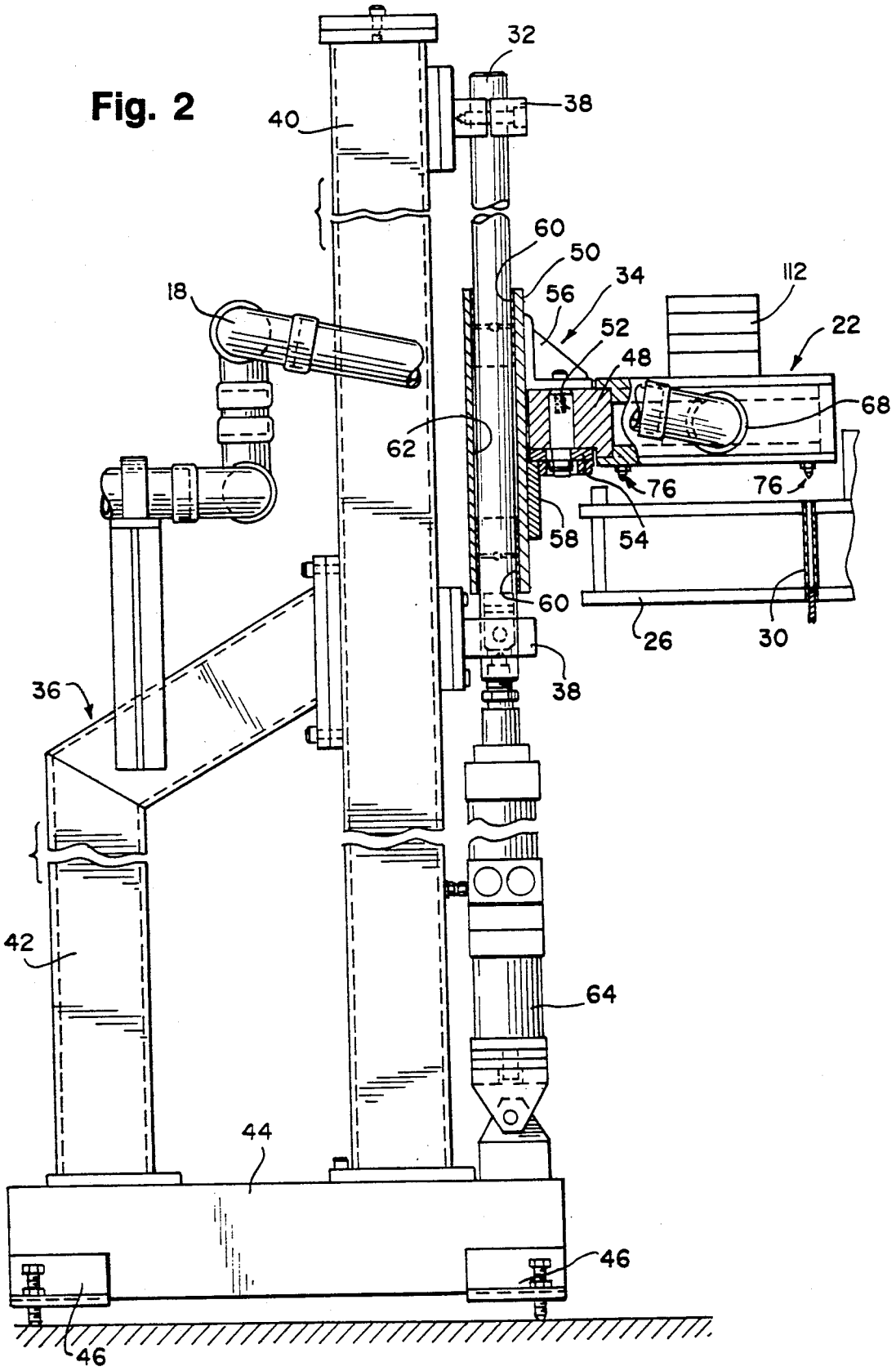
FIG. 2 is a side elevational view of the injection molding apparatus of the present invention.

As also seen in FIG. 1, the manifold valve is attached to and is vertically adjustable along a pair of guide shafts 32 by means of a manifold valve support assembly 34. The guide shafts 32, in turn, are affixed to the frame 36 by a pair of shaft clamps 38 (FIG. 2). The frame 36 consists of a pair of main legs 40 and a pair of support legs 42 mounted on a base 44. The base is provided with four pairs of adjustable leveling feet 46.

Figure 3:
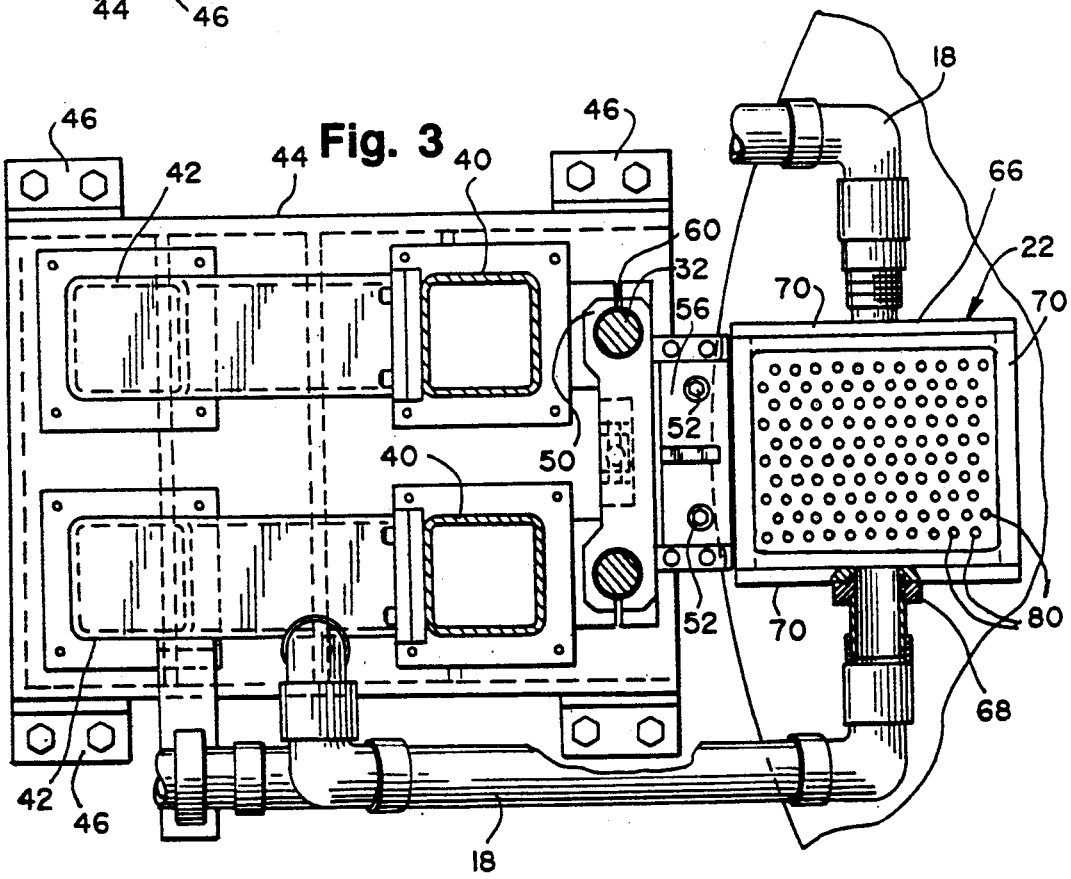
FIG. 3 is a top plan view of the injection molding apparatus of the present invention with the cover of the manifold removed.

The manifold valve support assembly 34 consists of a manifold valve support member 58, affixed to one end of the manifold valve 22, and a manifold valve carrier 50, slidably mounted on the guide shafts 32. The manifold valve support member 58 is interconnected to the manifold valve carrier 50 by a pair of support studs 52 interfit between the support member 58 and a support plate 54, FIGS. 2 and 3. Upper angle member 56 further secures the connection. A pair of guide bushings 60 line a pair of axial bores 62 in the manifold valve carrier 50 to allow the manifold carrier 50 to freely slide along the guide shafts 32.

The manifold valve carrier 50, and in turn the manifold valve 22, are vertically movable along the shafts 32 by means of an air cylinder 64 disposed beneath the manifold valve carrier 50 which is under the control of the programmable controller 12. In the preferred embodiment, it is desirable to have the manifold valve move as smoothly as possible. Thus, an air cylinder is selected. One such air cylinder is the Aro Air Hydraulic Cylinder Model No. 1321-2304-090. Of course, other types of devices, such as hydraulic cylinders or electric motors, could be employed to achieve the same results.

The preferred embodiment of the manifold valve 22 consists of a six-sided rectilinear enclosure. The viscous material is received through an inlet port 66 and is discharged through an exit port 68, disposed in opposite side walls 70 of the manifold valve 22. The side walls 70 and top plate 72 may be provided with heating elements (not shown) to maintain the viscous material at the appropriate temperature and state of viscosity. Similarly, the conduit or piping 18 is also heated by steam or electric heaters (not shown) to maintain the wax at an appropriate temperature. These heating elements are monitored and controlled by the programmable controller 12.

In the preferred embodiment, the wax is maintained under a pressure. Ideally, the pressure should be minimized to prevent leakage from the manifold valve 22. A range of 12–15 pounds per square inch and a temperature of approximately 200° F. have been found to be optimum conditions. The temperature is approximately 20 percent less than the minimum temperature used in conventional gravity fill devices.

The bottom plate 74 of the manifold valve 22 is provided with a plurality of injection orifices 76, through which the viscous material is injected into the appropriate underlying mold cavity or container. Depending upon the product to be made by the injection molding apparatus, the number and pattern of these orifices 76 may change. 110 orifices are employed in the preferred embodiment.

Figure 8:
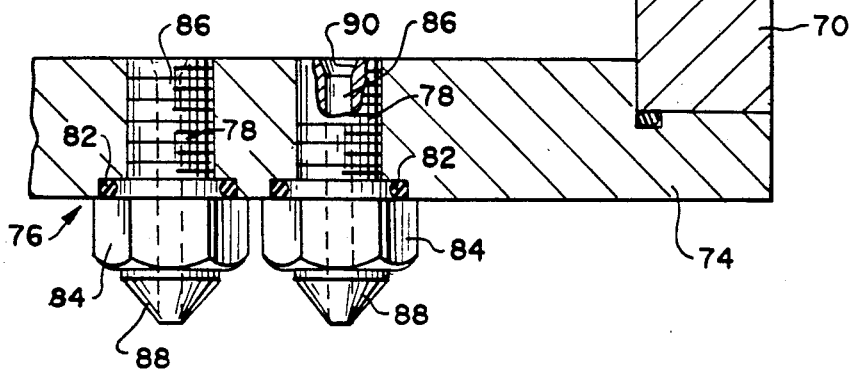
FIG. 8 is an enlarged partial cross-sectional view of the manifold highlighting the orifices and orifice pins.

As seen in FIGS. 5 and 8, each injection orifice 76 consists of a manifold shut-off insert 78 which is threadably received into a receptively threaded bore 80 in the bottom plate 74 of the manifold valve 22. A rubber seal or gasket 82 surrounds the insert to prevent leakage. The exposed or distal end of the manifold valve shut-off insert is further provided with a hexagonal shaped nut 84 to facilitate its insertion and removal from the bottom plate 74. An axial bore 86 extends the length of the manifold valve shut-off insert 78 for passage of the viscous material. The distal end is provided with a nozzle 88 for injecting the viscous material and the proximal end 90 is tapered.

The manifold valve 22 is further provided with a valve assembly 92 (FIG. 6) to control the timing and injection of viscous material. The valve assembly 92 consists of a vertically reciprocating platen 94 disposed within the manifold valve housing. Shut-off pins 96, affixed to the platen 94, act to seal the axial bores 86 and nozzles 88 to prevent the viscous materials from escaping. As seen in more detail in FIG. 8, the platen 94 consists of an upper and lower member 98 and 100, respectively. The lower member 100 includes a plurality of cutouts 102, corresponding in number and location to the orifices 76 disposed on the bottom plate 74 of the manifold valve 22, for secureably receiving the shut-off pins 96. Each shut-off pin 96 consists of a head portion 104, which is seated in the cutout 102 and a elongated body member 106. The tip 108 of each shut-off pin is tapered to be received within the tapered portion 90 of the axial bore 86 of the manifold shut-off insert 78. The upper portion 98 of the platen 94 consists of a plate which is secured to the lower portion 100 of the platen to hold the shut-off pins in place.

As further seen in FIG. 8, a wave washer 110 or other suitable shock absorbing device is positioned between the shut-off pins 96 and the upper plate 98 of the platen. The wave washer 110 allows for slight movement in the shut-off pin 96 to accommodate manufacturing tolerances and changes in dimensions due to thermal expansion and contraction when the pin 96 is seated in the tapered proximal end 90 of the axial bore 86.

A pneumatic cylinder 112, under the control of the programmable controller 12, controls the vertical movement of the platen 94 through the coupling mechanism shown in FIG. 4. A bimba cylinder having a one inch stroke is employed in the preferred embodiment, although a hydraulic cylinder or other mechanism known in the art may be substituted.

As can be seen, the male portion 114 of the manifold coupling is attached to the platen 94 by means of the female coupling member 116 which has a recessed portion 117 to receive the head 120 of the male coupling 114. The female coupling member 116 is connected to the platen 94 by means of cap screws 122. An o-ring 124 encircles the perimeter of the head 120 of the male coupling 114 to provide a snug or secure fit between the male coupling member 114 and the female coupling member 116 and to also allow some flexibility of platen movement relative to the male coupling portion 114 to insure proper fit of the shut-off pins 96 in the tapered portion 90 of the injection orifices 76. The opposite end of the male coupling member 114 is, in turn, connected to the pneumatic cylinder 112. A further gasket or seal 126 is disposed in the top plate 72 of the manifold valve housing to further prevent leakage. As can be seen in FIGS. 4 through 7, the interior surface of the top plate 72 of the manifold valve 22 is provided with a recess 118 to accommodate the female coupling member 116 when it is in its raised position.

Figure 6:
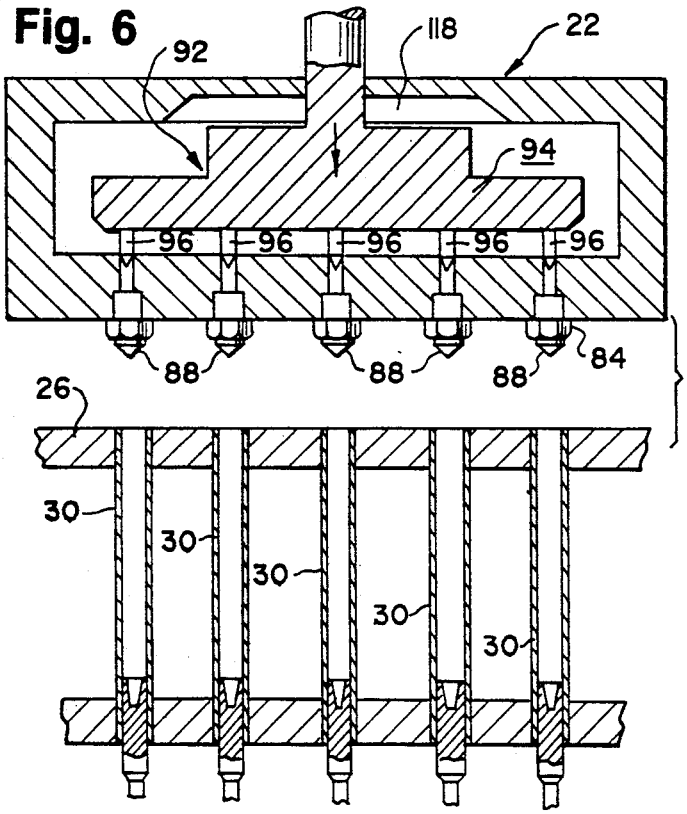
FIG. 6 is a cross-sectional schematic view of the manifold and mold compartment of the present invention showing the platen in its lowermost position with the orifice pins seated in their respective orifices.
Figure 7:
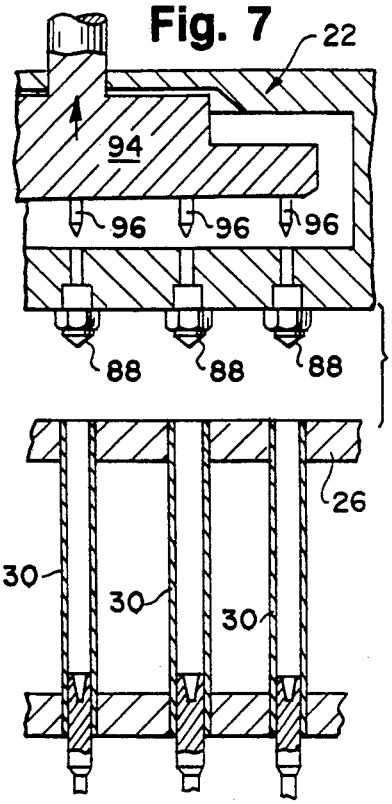
FIG. 7 is a partial cross-sectional schematic view of the manifold and mold compartment with the platen in its uppermost position.
Figure 7:
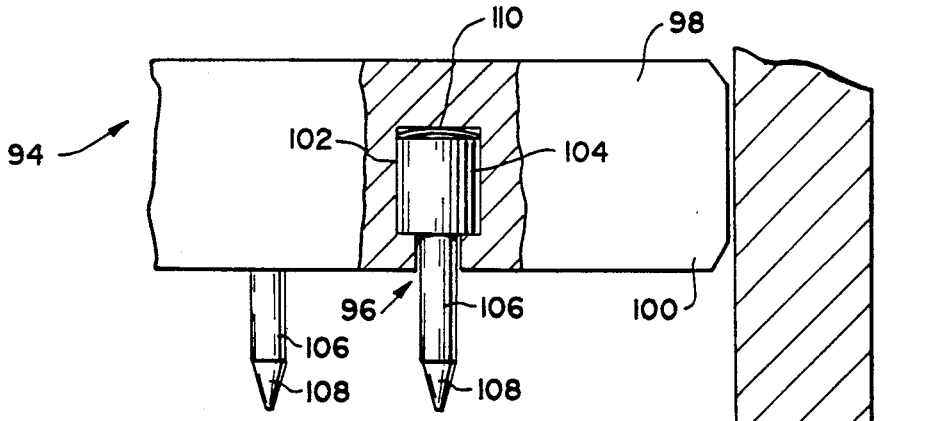

Operation of the manifold valve is shown in schematic view in FIGS. 6 and 7. As seen in FIG. 6, the manifold valve 22 is positioned above a plurality of mold cavities 30 housed in the mold table 26 with the injection orifices 76 aligned with the mold cavities 30. As can further be seen, the platen 94 is in a lowered position with the shut-off pins 96 seated within the tapered portions 90 of the axial bores 86. At this point, the programmable controller 12 closes the process control valve 24, located downstream from the manifold valve 22, which blocks the flow path of the wax. Simultaneously, the programmable controller 12 activates the pneumatic cylinder 112 which controls the manifold valve 22 and raises the platen 94 to open the manifold valve 22. Thus, when the platen 94 is moved to a raised position, FIG. 7, the shut-off pins 96 are removed from the tapered portions 90 of the axial bore 86 and the viscous material, under pressure, is injected into the mold cavities 30.

When sufficient material has been injected, the pneumatic cylinder 112 is activated by the programmable controller 12 and the platen 94 is lowered to seat the shut-off pins 96 in the axial bores 86 of the manifold shut-off insert 78. Simultaneously, the process control valve 24 is opened by the programmable controller 12 to allow the molten wax to resume circulation. The rotary table 26 is then advanced to the next position by the programmable controller 12 activating the table motor and the process is repeated.

For safety reasons, the programmable controller 12 monitors the pressure of the wax in addition to monitoring the relative positions of the process control valve 24 and manifold valve 22. Thus, if either of the valves fail to operate properly or if the pressure of the wax exceeds a predetermined amount, the relief valve 20 will open and the wax will be circulated through a return path to the reservoir 14.

The programmable controller 12 monitors the speed of the pump 16 along with the pressure of the wax to determine the length of time the manifold valve 22 should be open to fill the mold cavities 30. However, to account for variations, each mold cavity is slightly overfilled to form a small bubble of wax (not shown) at the top of each cavity. This wax is melted at a remelt zone (not shown) located approximately three or four indexed positions away from the fill position on the mold table 26. Thus, after cooling has started, if the wax shrinks or cracks, the excess wax is melted to fill any voids. The temperature of the remelt zone is also under the control of the programmable controller 12. Any excess wax is removed at the end of the manufacturing process in a conventional manner.

While the foregoing description only shows one embodiment of the invention, the invention is not limited thereto since one may make modifications, and other embodiments of the principles of the invention will occur to those of skill in the art to which the invention pertains, particularly upon considering the foregoing teachings.

In particular, an alternative embodiment of the present invention is shown in schematic in FIG. 9. As can be seen, injector extensions 130 have been added to the injector orifices 76 and extend inside the respective mold cavities 30. As injection occurs, the entire manifold valve 22 is raised by the air cylinder 64, FIG. 2, to allow the viscous material to fully fill the mold cavity.

These extensions 130 insure complete fill for non-uniform mold cavities and when using highly viscous materials. However, unlike the first embodiment, which does not use extensions, the manifold valve 22 of the second embodiment must be raised to allow the mold table 26 to advance to the next position without interference from the extensions 130. This operation is controlled by the programmable controller 12.

What we claim is:

1. An apparatus for injecting viscous material comprising a vertically adjustable manifold, said manifold having a top, a bottom and perimeter side walls to define a hollow cavity for receiving viscous material for subsequent injection into a container, means for supplying pressurized viscous material to said cavity, a plurality of injection orifices disposed in said manifold bottom, a vertically reciprocating platen disposed within said cavity and having a plurality of orifice pins corresponding to the number of injection orifices and positioned relative to said injection orifices such that when said platen is in a lowered position said orifice pins are seated within and block said orifices and when said platen is in a raised position said orifice pins are removed from said injection orifices and said injection orifices are open.

2. The apparatus for injecting viscous material of claim 1 further comprising elongate tubular extensions subtending said injection orifices.

3. The apparatus for injecting viscous material of claim 1 wherein said manifold is heated to maintain the viscous material in a specific state of viscosity.

4. The apparatus for injecting viscous material of claim 1 further comprising monitoring and control means for monitoring and controlling the pressure and temperature of the viscous material and the position of said platen.

5. The apparatus for injecting viscous material of claim 1 wherein the viscous material is a wax blend for making crayons.

6. An apparatus for injecting viscous material comprising a vertically adjustable manifold, said manifold defining a hollow cavity for receiving viscous material, circulating means for supplying pressurized viscous material to said cavity, a plurality of injection orifices disposed in said manifold, a vertically reciprocating platen disposed within said cavity and having a plurality of orifice pins corresponding to the number of injection orifices and positioned relative to said injection orifices such that when said platen is in a lowered position said orifice pins are seated within and block said injection orifices and when said platen is in a raised position said orifice pins are removed from said injection orifices and said viscous material is forced through said injection orifices and out of said cavity.

7. The apparatus for injecting viscous material of claim 6 comprising elongate tubular extensions subtending said orifices.

* * * * *